US006654962B2

(12) United States Patent
DeMott

(10) Patent No.: US 6,654,962 B2
(45) Date of Patent: Dec. 2, 2003

(54) PROTECTIVE KNEE PAD SYSTEM

(75) Inventor: Garth D. DeMott, Portage, WI (US)

(73) Assignee: DeMott-Steinhaus Group, Portage, WI (US)

( * ) Notice: Subject to any disclaimer, the term of this patent is extended or adjusted under 35 U.S.C. 154(b) by 2 days.

(21) Appl. No.: 10/190,985

(22) Filed: Jul. 3, 2002

(65) Prior Publication Data

US 2003/0005505 A1 Jan. 9, 2003

Related U.S. Application Data

(60) Provisional application No. 60/303,723, filed on Jul. 9, 2001.

(51) Int. Cl.[7] ..... A41D 13/00

(52) U.S. Cl. ..... 2/22; 2/46; 2/242

(58) Field of Search ..... 2/22, 23, 24, 16, 2/242, 46, 59, 455, 62, 227, 911, 919; 128/878, 882; 602/23, 26, 62

(56) References Cited

U.S. PATENT DOCUMENTS 562,608 A * 6/1896 Herbelin ..... 2/24
589,562 A * 9/1897 Gray ..... 2/51
1,580,453 A * 4/1926 Stentford ..... 36/2 R
2,266,886 A * 12/1941 McCoy ..... 2/22
3,269,036 A * 8/1966 Parker et al. ..... 36/2 B
4,506,391 A * 3/1985 Rodman ..... 2/227
RE32,506 E * 9/1987 Hightower ..... 2/22
4,697,286 A * 10/1987 Cho ..... 2/22
5,033,126 A * 7/1991 Wruck et al. ..... 2/242
5,594,954 A * 1/1997 Huang ..... 2/24
6,065,151 A * 5/2000 Conine, III ..... 2/22

* cited by examiner

*Primary Examiner*—Tejash Patel

(57) ABSTRACT

A protective knee pad system for protecting the knees and legs of an individual in a comfortable manner. The protective knee pad system includes a length of leg covering having an upper opening and a lower opening, and a pad member secured to the front knee portion of the leg covering. The pad member is comprised of a cover member, a first cushion, a first band and a second band, and a second cushion. The first band and second band are preferably comprised of a bendable material for allowing forming of the pad member to the shape of the knee.

9 Claims, 7 Drawing Sheets

PROTECTIVE KNEE PAD SYSTEM

CROSS REFERENCE TO RELATED APPLICATIONS

I hereby claim benefit under Title 35, United States Code, Section 119(e) of U.S. provisional patent application Serial No. 60/303,723 filed Jul. 9, 2001. The No. 60/303,723 application is currently pending. The No. 60/303,723 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to knee pads and more specifically it relates to a protective knee pad system for protecting the knees and legs of an individual in a comfortable manner.

2. Description of the Related Art

Knee pads have been in use for years. Typically, a knee pad is comprised of a cushion material contained within a housing with a pair of straps attached thereto for securing about the knee joint of the leg. Knee pads are unfortunately relatively uncomfortable for individuals, particularly since the straps must be tightened to prevent slippage of the pads upon the leg of the individual. The straps tend to cause discomfort to the individual over extended periods of time. Another problem with conventional knee pads is that they do not provide protection for the entire leg thereby causing the pants of the individual to become worn and damaged.

While these devices may be suitable for the particular purpose to which they address, they are not as suitable for protecting the knees and legs of an individual in a comfortable manner. Conventional knee pads are uncomfortable to wear over extended periods of time.

In these respects, the protective knee pad system according to the present invention substantially departs from the conventional concepts and designs of the prior art, and in so doing provides an apparatus primarily developed for the purpose of protecting the knees and legs of an individual in a comfortable manner.

BRIEF SUMMARY OF THE INVENTION

In view of the foregoing disadvantages inherent in the known types of knee pads now present in the prior art, the present invention provides a new protective knee pad system construction wherein the same can be utilized for protecting the knees and legs of an individual in a comfortable manner.

The general purpose of the present invention, which will be described subsequently in greater detail, is to provide a new protective knee pad system that has many of the advantages of the knee pads mentioned heretofore and many novel features that result in a new protective knee pad system which is not anticipated, rendered obvious, suggested, or even implied by any of the prior art knee pads, either alone or in any combination thereof.

To attain this, the present invention generally comprises a length of leg covering having an upper opening and a lower opening, and a pad member secured to the front knee portion of the leg covering. The pad member is comprised of a cover member, a first cushion, a first band and a second band, and a second cushion. The first band and second band are preferably comprised of a bendable material for allowing forming of the pad member to the shape of the knee.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a protective knee pad system that will overcome the shortcomings of the prior art devices.

A second object is to provide a protective knee pad system for protecting the knees and legs of an individual in a comfortable manner.

Another object is to provide a protective knee pad system that reduces the pain associated with wearing protective knee devices.

An additional object is to provide a protective knee pad system that may be utilized by individuals in various professions such as but not limited to roofers, carpenters, carpet layers, concrete workers, electricians, painters, gardeners, welders and sand blasters.

A further object is to provide a protective knee pad system that protects the entire leg.

Another object is to provide a protective knee pad system that is adjustable to accommodate various individuals.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
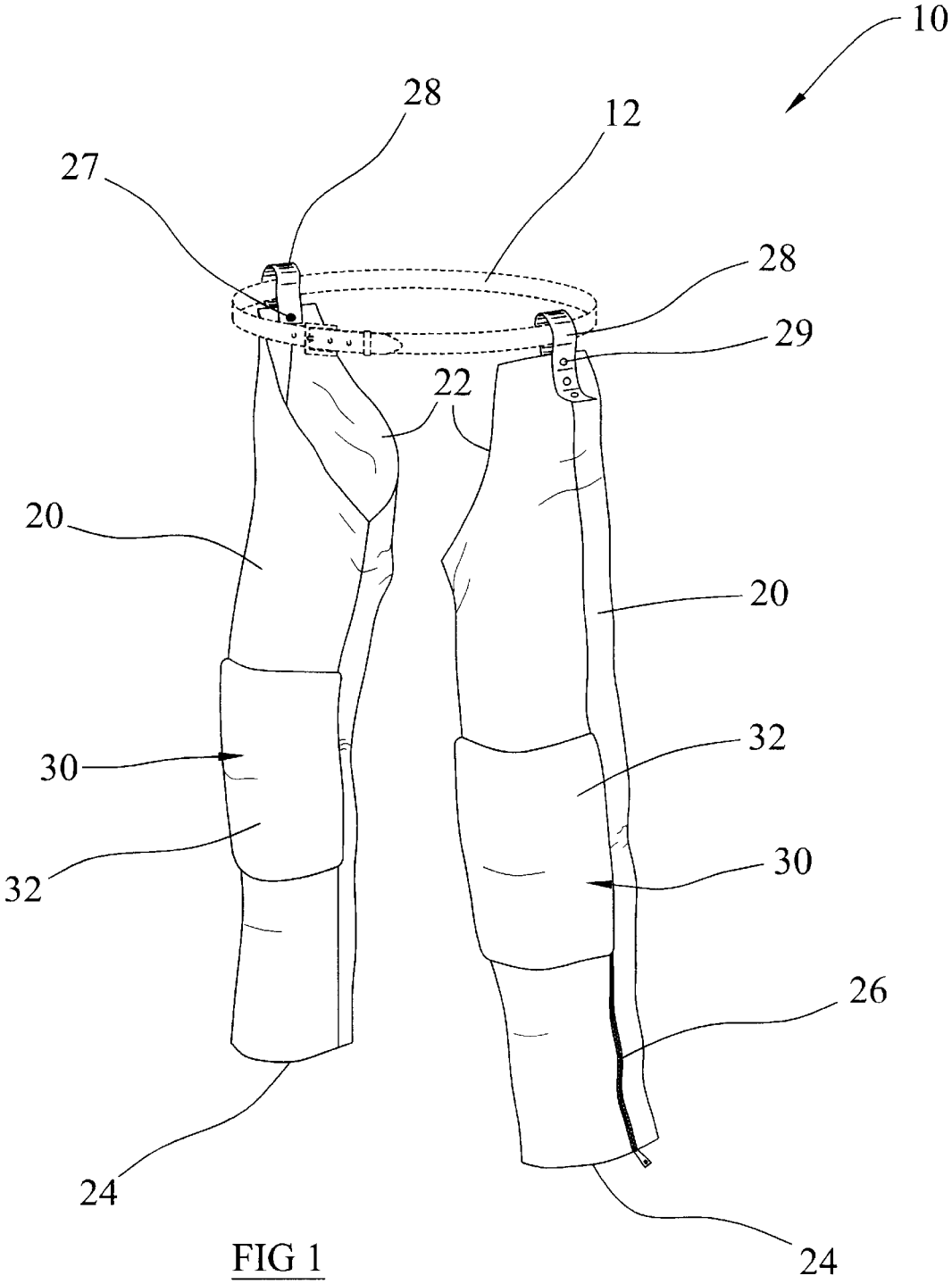
FIG. 1 is an upper perspective view of the present invention.

Turning now descriptively to the drawings, in which similar reference characters denote similar elements throughout the several views, FIGS. 1 through 7 illustrate a protective knee pad system 10, which comprises a length of leg covering 20 having an upper opening 22 and a lower opening 24, and a pad member 30 secured to the front knee portion of the leg covering 20. The pad member 30 is comprised of a cover member 32, a first cushion 34, a first band 38 and a second band 39, and a second cushion 36. The first band 38 and second band 39 are preferably comprised of a bendable material for allowing forming of the pad member 30 to the shape of the knee.

As shown in FIG. 1 of the drawings, the leg covering 20 is formed to fit about either the right leg or left leg of an individual. For the purposes of this application, only one leg covering 20 will be discussed thought it can be appreciated that more than one leg covering 20 will typically be utilized by an individual.

Figure 2:
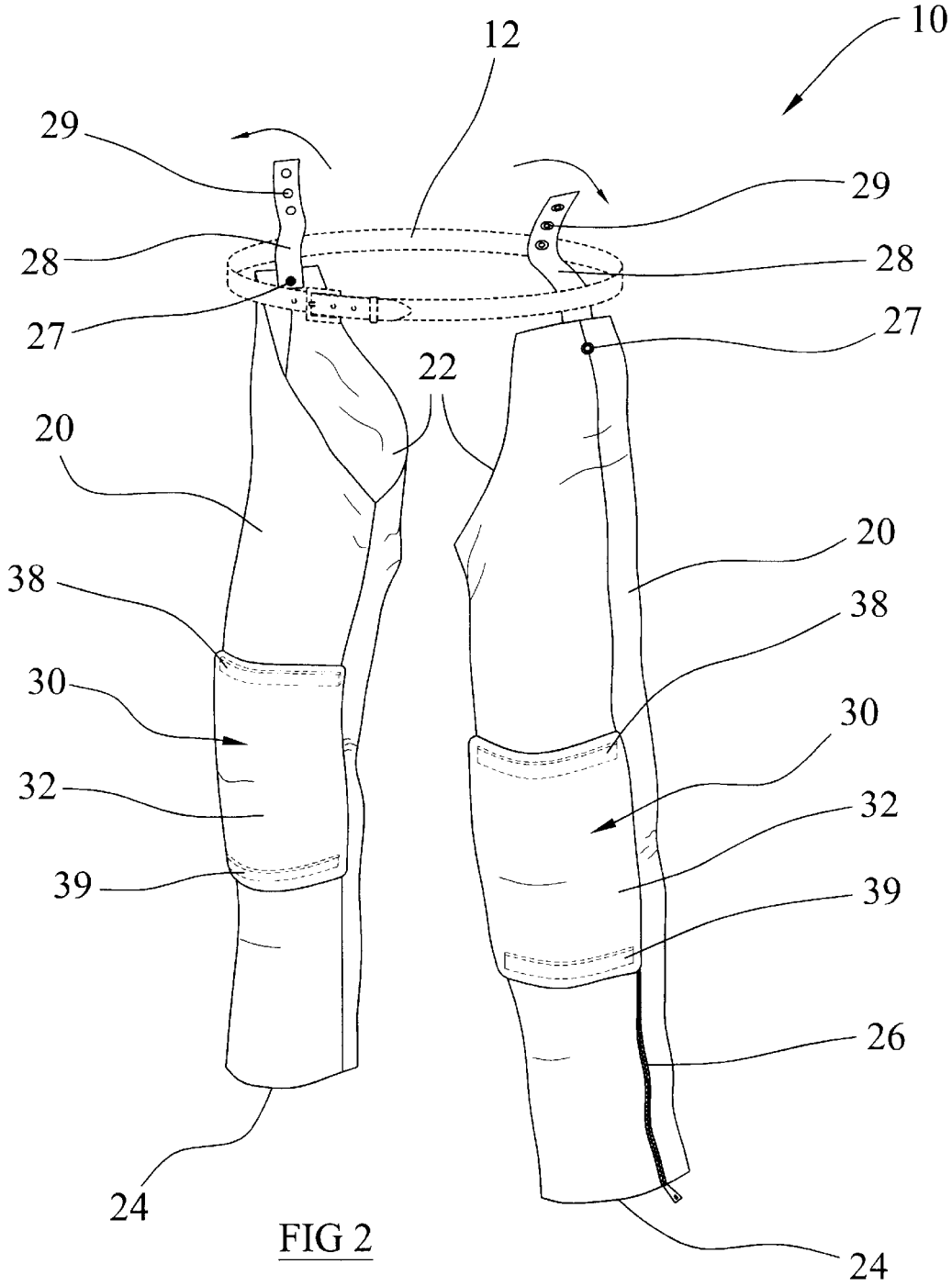
FIG. 2 is an upper perspective view of the present invention illustrating the band members within the knee pads.

As further shown in FIG. 1 of the drawings, the leg covering 20 is comprised of an elongate tubular structure having an upper opening 22 and a lower opening 24. The upper opening 22 is preferably angled upwardly from the inner portion to the outer portion as shown in FIGS. 1 and 2 of the drawings. The leg covering 20 preferably extends along the entire length of the leg of an individual. The leg covering 20 is further preferably positionable about the pants or shorts of an individual. In an alternative embodiment shown in FIG. 7 of the drawings, the leg covering 20 is comprised of a shorter length wherein the lower opening 24 is positioned just below the pad member 30.

The leg covering 20 may be comprised of various types of materials. For example, the leg covering 20 may be comprised of a nylon netting, textile, canvas, leather, synthetic, plastic or other material having generally flexible characteristics suitable for being positioned about the leg of an individual.

Figure 4:
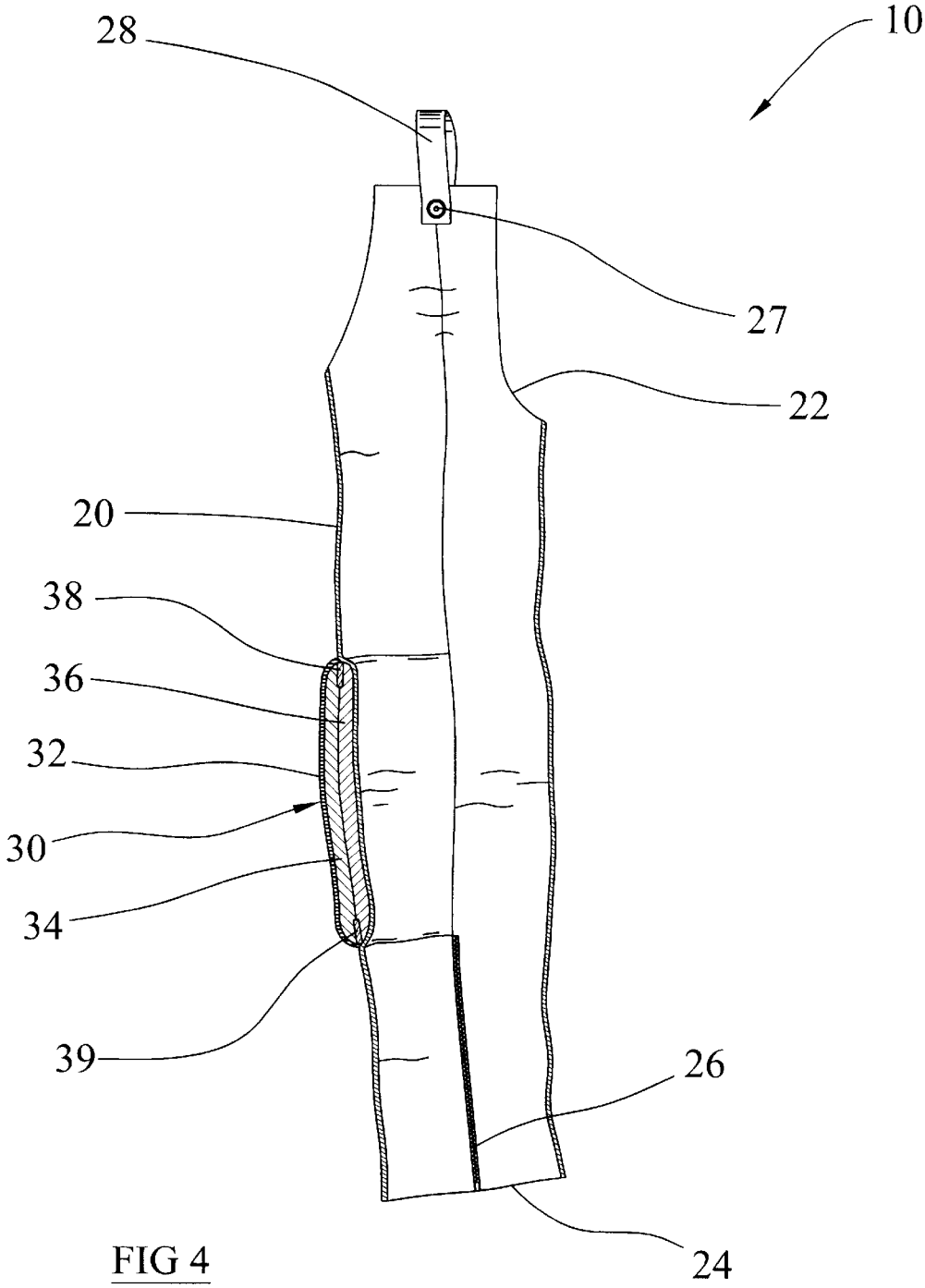
FIG. 4 is a side cutaway view of the present invention.
Figure 5:
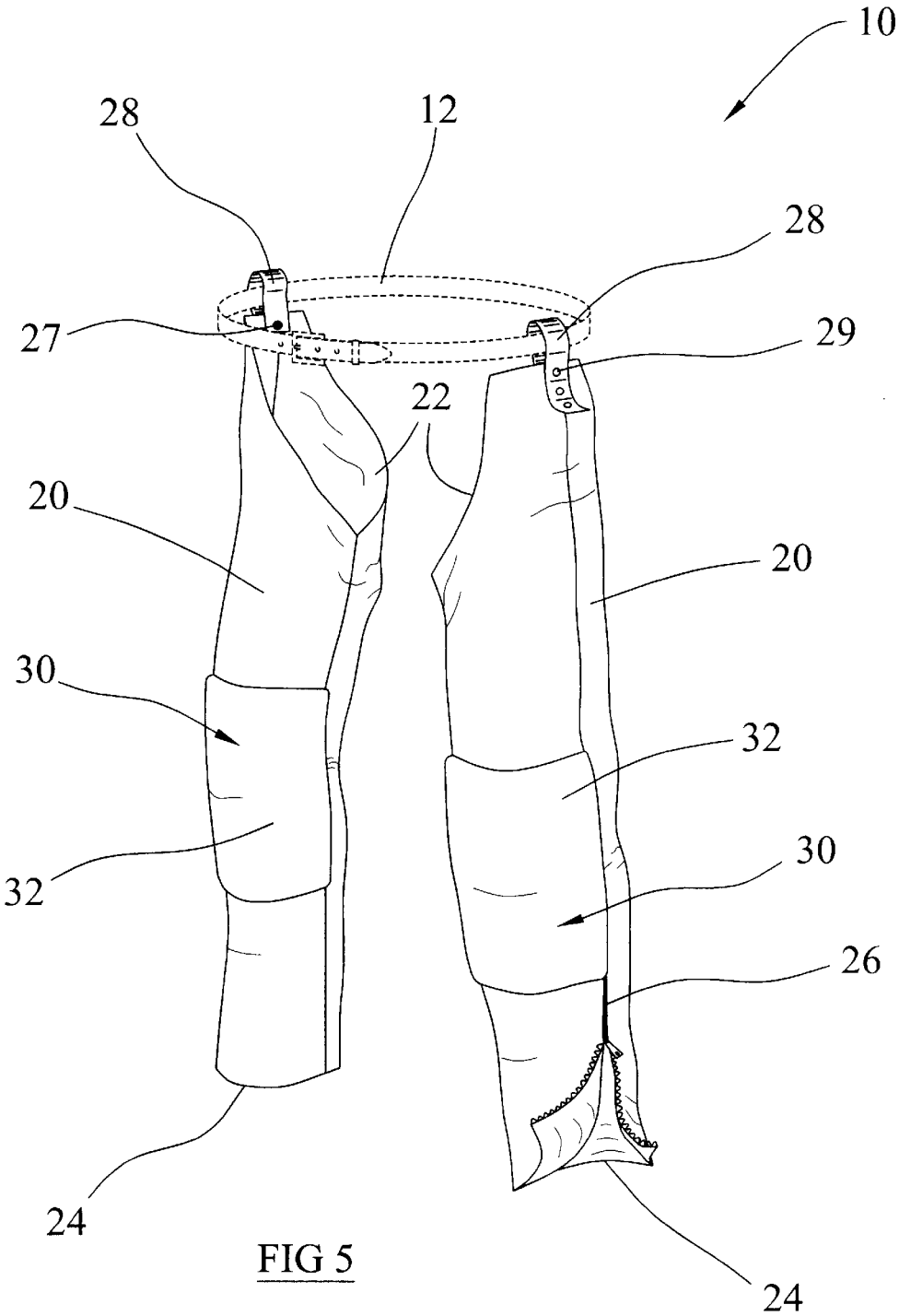
FIG. 5 is an upper perspective view of the present invention with the zipper opened.

As shown in FIGS. 1 and 4 of the drawings, a zipper 26 is positioned within the lower portion of the leg covering 20 in a longitudinal manner for allowing opening and closing thereof upon a leg of an individual. The zipper 26 facilitates easy passage of the leg covering 20 about the lower leg and shoes of an individual. Various other fasteners may be utilized in place of the zipper 26 such as but not limited to buttons, hook and loop fastener and the like.

As shown in FIG. 1 of the drawings, at least one strap member 28 is attached to the upper portion of the leg covering 20 preferably near the upper opening 22. The strap member 28 is comprised of an elongate structure capable of being extended about the belt 12 of the individual using the present invention. The strap member 28 may be comprised of various types of materials such as but not limited to plastic, leather, textile and the like.

At least one first fastener 27 is attached to the leg covering 20 as shown in 2 of the drawings. At least one second fastener 29 is attached to the distal portion of the strap member 28 for selectively engaging the first fastener 27 after being positioned about the belt 12 or other structure of the individual thereby retaining the leg covering 20 in an upright position about the leg of the individual. The first fastener 27 and the second fastener 29 may be comprised of various fastener devices such as but not limited to buttons, snap buttons, hook and loop fastener, clips, buckles and the like. There are preferably a plurality of second fasteners 29 for allowing adjustment of the length of the strap member 28 to position the leg covering 20 properly and comfortably about the leg of the individual.

The pad member 30 is secured to the outer knee portion of the leg covering 20 wherein the individual's knee is positioned. The pad member 30 is preferably comprised of a cover member 32 and at least one cushion. Each cushion is preferably comprised of a relatively soft material capable of softening the engagement of the knee upon a hard surface. However, the cushions may be comprised of a relatively rigid material depending upon the purpose of the pad member 30. Cushions within the knee pad industry are commonly utilized. FIG. 4 illustrates the usage of a first cushion 34 and a second cushion 36 secured between the outer surface of the leg covering 20 and the inner surface of the cover member 32. Various other structures may be utilized to construct the pad member 30.

Figure 3:
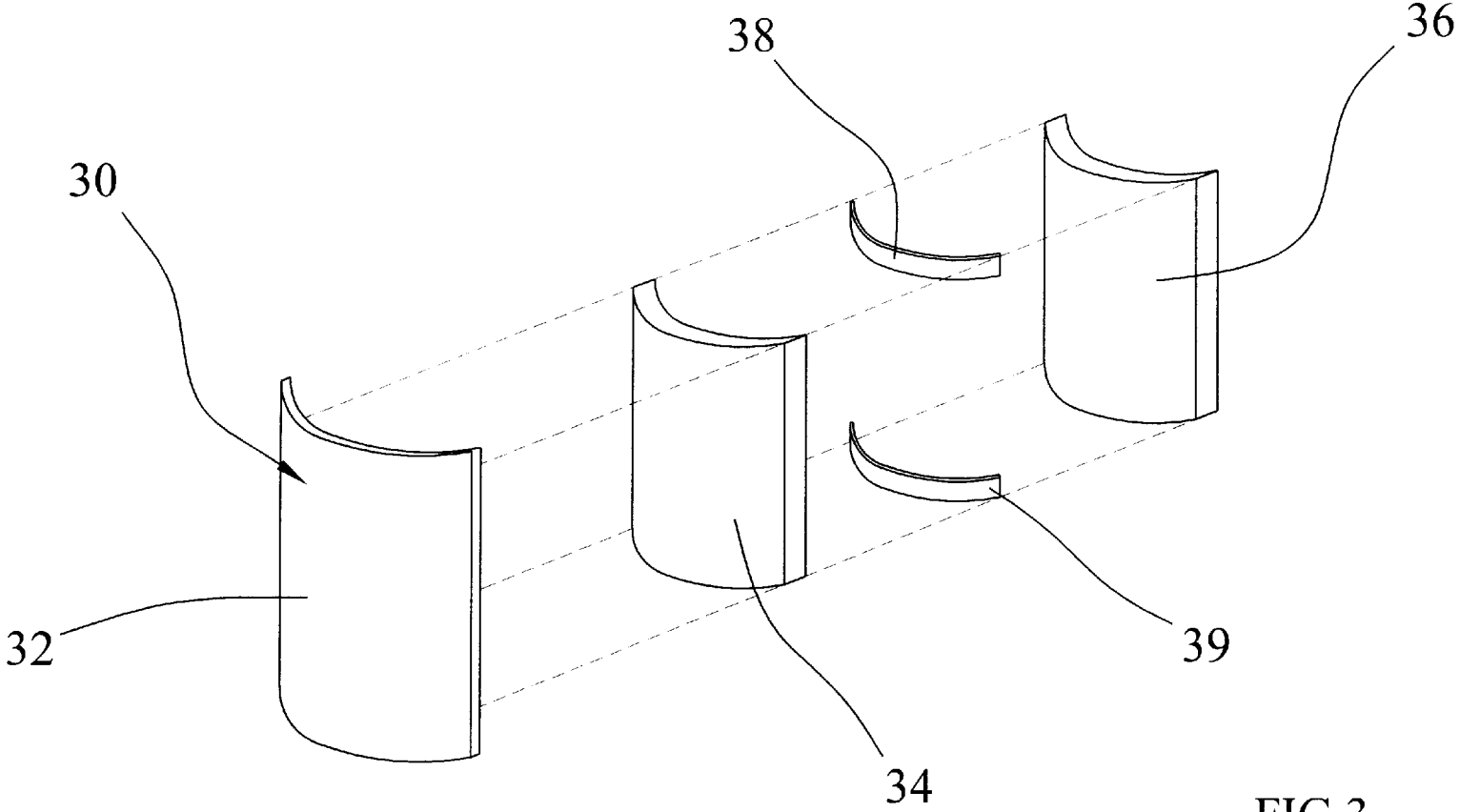
FIG. 3 is an exploded view of the pad member.

As shown in FIGS. 2 and 4 of the drawings, a plurality of band members 38, 39 are preferably utilized within he pad member 30 for allowing the user to physically mold the shape of the pad member 30. As shown in FIGS. 2, 3 and 4 of the drawings, a first band 38 is positioned within an upper portion of the pad member 30 and a second band 39 is positioned within the lower portion of the pad member 30. The first band 38 and the second band 39 are preferably comprised of a bendable material such as but not limited to metal. The first band 38 and the second band 39 preferably have a narrow elongate structure that extend transversely within the opposing portions of the pad member 30. As shown in FIG. 4 of the drawings, the first band 38 and the second band 39 preferably are positioned between the first cushion 34 and the second cushion 36 in a secured manner. The bands 38, 39 may be positioned within various other manners and locations within the pad member 30.

Figure 6:
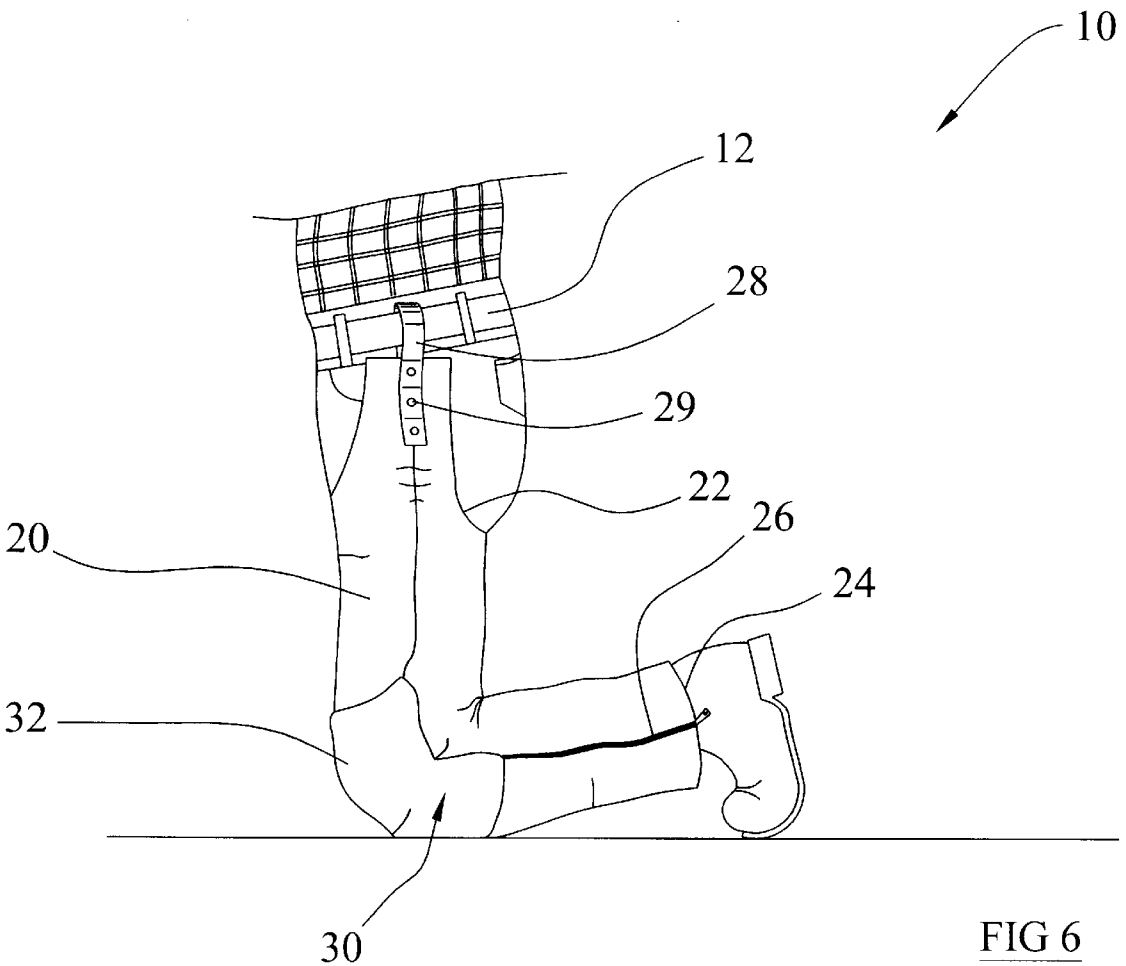
FIG. 6 is a side view of the present invention positioned upon an individual in a kneeling position.
Figure 7:
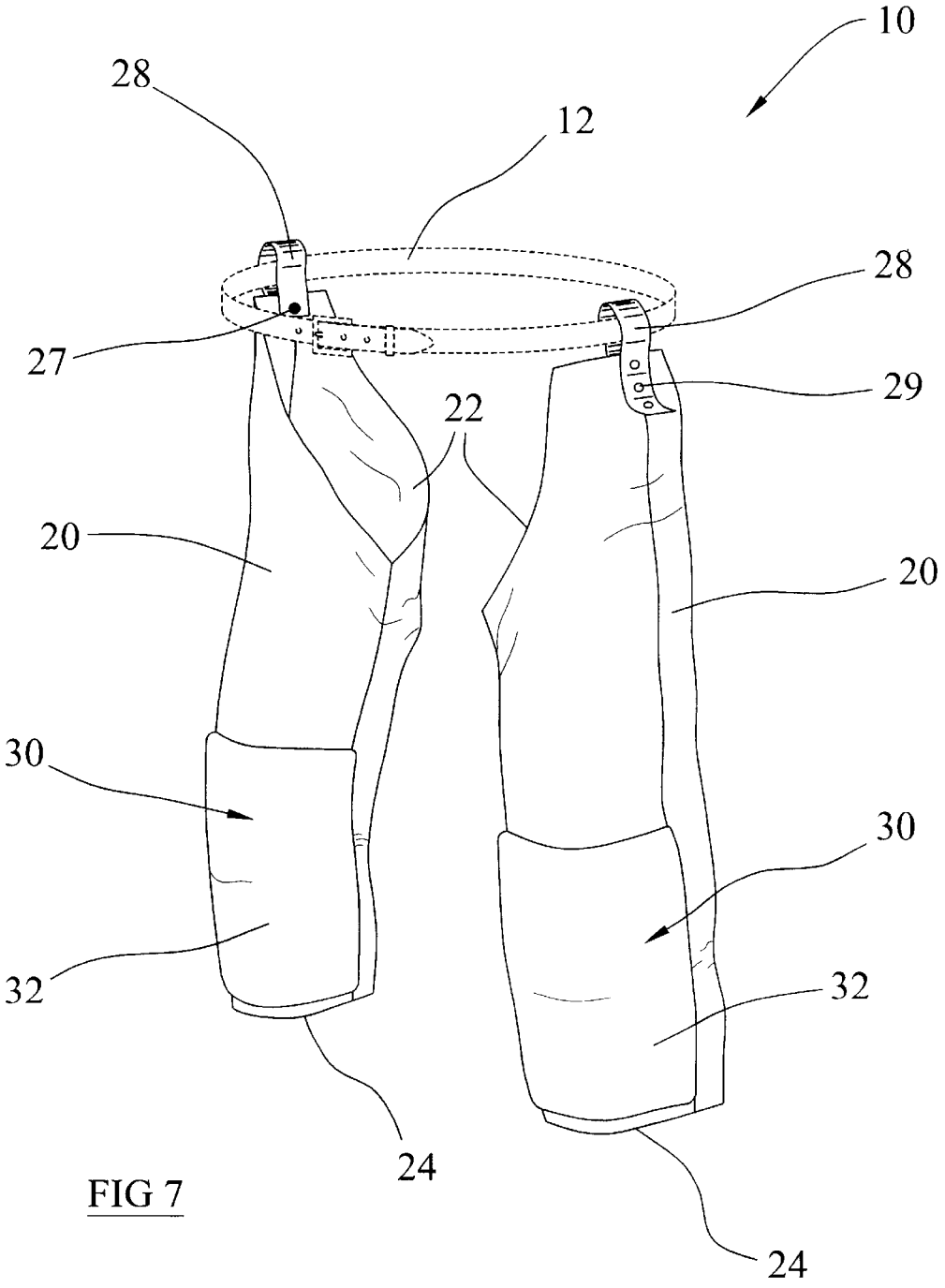
FIG. 7 is an upper perspective view of an alternative embodiment illustrating a shortened leg covering.

In use, the user enters their foot and leg into the upper opening 22 of the leg covering 20. The user continues to extend their leg through the leg covering 20 until fully exited from the lower opening 24. The user then secures the zipper 26 about the lower leg. The user then extends the strap member 28 about the belt 12 or other structure upon their body. The user then secures one of the second fasteners 29 to the first fastener 27 to maintain the leg covering 20 at the desired height upon their leg. The user then repeats this process for the opposing leg. The user is then able to kneel upon hard surfaces with reduced stress and impact to their knee as shown in FIG. 6 of the drawings. When finished, the user simply removes the second fastener 29 from the first fastener 27 and then withdraws their leg from the leg covering 20.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A protective knee pad system, comprising:

a leg covering having an upper opening and a lower opening;

a pad member attached to a knee portion of the leg covering, where n said pad member is comprised of a cover member and at least one cushion positioned between said cover member and said leg covering, wherein said at least one cushion is comprised of a first cushion and a second cushion positioned adjacent to one another;

a strap member attached to an upper portion of said leg covering;

a first fastener attached to said leg covering;

a second fastener attached to a distal portion of said strap member for selectively engaging said first fastener; and at least one band positioned within said pad member, wherein said at least one band is constructed of a bendable material and wherein said at least one band is positioned relatively transversely with respect to said leg covering;

wherein said at least one band is comprised of a first band and a second band.

2. The protective pad system of claim 1, wherein said first band is positioned within an upper portion of said pad member and wherein said second band is positioned within an lower portion of said pad member.

3. The protective knee pad system of claim 1, including a zipper positioned within a lower portion of said leg covering extending in a longitudinal manner.

4. The protective knee pad system of claim 1, wherein said upper opening is angled upwardly from an inner portion to an outer portion of said leg covering.

5. A protective knee pad system, comprising:

a leg covering having an upper opening and a lower opening;

a pad member attached to a knee portion of the leg covering, wherein said pad member is comprised of a cover member and at least one cushion positioned between said cover member and said leg covering, wherein said at least one cushion is comprised of a first cushion and a second cushion positioned adjacent to one another;

a strap member attached to an upper portion of said leg covering;

a first fastener attached to said leg covering;

a second fastener attached to a distal portion of said strap member for selectively engaging said first fastener; and at least one band positioned within said pad member, wherein said at least one band is constructed of a bendable material and wherein said at least one band is positioned relatively transversely with respect to said leg covering;

wherein said at least one band is comprised of a first band and a second band;

wherein said leg covering is comprised of a breathable and porous material.

6. The protective knee pad system of claim 5, wherein said first band is positioned within an upper portion of said pad member and where n said second band is positioned within an lower portion of said pad member.

7. The protective knee pad system of claim 5, including a zipper positioned within a lower portion of said leg covering extending in a longitudinal manner.

8. The protective knee pad system of claim 5, wherein said upper opening is angled upwardly from an inner portion to an outer portion of said leg covering.

9. The protective knee pad system of claim 1, wherein said first band is positioned within an upper portion of said pad member and wherein said second band is positioned within an lower portion of said pad member.

* * * * *